United States Patent [19]

Klaucic

[11] Patent Number: 4,469,163

[45] Date of Patent: Sep. 4, 1984

[54] DUMMY BARS EMPLOYING A QUICKLY AND AUTOMATICALLY DETACHABLE END

[75] Inventor: Luciano Klaucic, Ronchi Dei Legionari, Italy

[73] Assignee: Danieli & C. Officine Meccaniche SpA, Italy

[21] Appl. No.: 380,235

[22] Filed: May 20, 1982

[30] Foreign Application Priority Data

May 27, 1981 [IT] Italy ..... 83395 A/81

[51] Int. Cl.[3] ..... B22D 11/08

[52] U.S. Cl. ..... 164/446; 164/426; 403/330

[58] Field of Search ..... 164/425, 426, 445, 446; 403/330, 322, 316

[56] References Cited

U.S. PATENT DOCUMENTS 4,222,432 9/1980 Scheurecker ..... 164/446

FOREIGN PATENT DOCUMENTS 1583605 10/1970 Fed. Rep. of Germany ..... 164/446
2701164 7/1977 Fed. Rep. of Germany ..... 164/445
1301523 7/1962 France ..... 164/446
729359 5/1955 United Kingdom ..... 164/446
624704 9/1978 U.S.S.R. ..... 164/446

*Primary Examiner*—Nicholas P. Godici
*Assistant Examiner*—Thomas S. Mieczkowski
*Attorney, Agent, or Firm*—Stevens, Davis, Miller & Mosher

[57] ABSTRACT

Dummy bars with a detachable end comprising: an end portion which has a hook of a smaller width and is an integral part of the dummy bar and a lodgement groove stretching lengthwise in said dummy bar, a detachable head which bears on its outside a connection for attachment of the billet and has within itself a lengthwise groove containing an inside crosswise attachment pin, whereby the groove can lodge the hook of the dummy bar, and whereby said hook cooperates from above with said attachment pin, abuttments provided on the lower side between the end portion with hook and the detachable head and which enable the detachable head to rotate in one direction in relation to the end portion, a latch which pivots within the lodgement groove and can close from below against the attachment pin, a bar to actuate the latch provided and hinged at the end of the latch, and a tension spring connected at one end to the inner end of the bar and at their other end to the body of the dummy bar.

10 Claims, 4 Drawing Figures

DUMMY BARS EMPLOYING A QUICKLY AND AUTOMATICALLY DETACHABLE END

This invention relates to dummy bars having a quickly automatically detachable end.

More particularly, the invention relates to dummy bars having end which is hooked onto the head that is anchored to the billet forming in the continuous casting process.

Dummy bars are already known which have devices for hooking the head that withdraws the billet forming in the continuous casting process.

Some of these devices consist of a simple hook which is hooked onto a pin provided in the head which withdraws the billet. Besides the ease and speed with which they can be unhooked, the devices are not reliable enough while the billet is being extracted.

Other devices embody the connection between the end of the dummy bar and the head withdrawing the billet by introducing between the two elements a bolt passing through them and having a notch on its shank.

When the withdrawal of the billet has been completed and the billet enters the extraction group, a vertical shearing thrust is exerted on the end and cuts the bolt at the position of the notch.

This kind of device involves the drawback of needing a strong outside thrust to shear the bolt and also a new bolt for each casting.

Other known devices consist of a gripper means with shaped arms locked by a spring on appropriate seatings provided on the head withdrawing the billet, whereby the gripper means can be released by exerting against the arms a thrust opposed to that of the spring. There also are devices consisting of a rocker element provided on one arm of a hook so as to obtain the connection with the head withdrawing the billet. The device is released by exerting pressure on the arm of the rocker element opposite to the arm equipped with a hook.

The devices entail the drawback of requiring an outside thrusting action to unhook them, whereby the outside thrust is exerted by appropriate outside means on the elements which arrange for the hooking of the end of the dummy bar onto the head withdrawing the billet, the unhooking operation obviously being complex and slow.

The invention has the purpose of embodying an end for dummy bars which enables the head withdrawing the billet to be detached speedily, whereby the end is suitable for any kind of continuous casting machines and is particularly suitable for continuous casting machines that employ a parking system for dummy bars in which the dummy bar is taken onto a swinging parking structure capable of being lifted by rotation above the casting line. The end also can be used advantageously on casting machines using any parking system which lifts the dummy bar from the casting line.

Moreover, the end of the dummy bar according to the invention is suitable for use on any kind of dummy bar, whether stiff or flexible, articulated or chain-type.

To sum up, the end according to the invention unites the simplicity and speed of detachment of ends having a simple hook with the reliability of ends having a gripper or rocker element and is particularly advantageous wherever the system for parking the dummy bar lifts the bar since automatic detachment of the head on the billet is obtained without any specific action.

This invention is therefore embodied in an end for dummy bars which comprises:

- a terminal part having a hook of lesser width than itself, the terminal part being an integral part of the dummy bar and comprising a lodgement groove which extends lengthwise within the dummy bar,
- a detachable head bearing outwardly a means for attachment to the billet and comprising inwardly a lengthwise groove having within it a crosswise attachment pin, whereby the groove can lodge the terminal hook-wise part of the dummy bar and the hook cooperates from above with the attachment pin,
- abutting means in the lower part between the terminal hook-wise part and the detachable head, and
- latch-type contrast means having a lower shaped portion and pivoted in the lodgement groove and able to hold the attachment pin on the lower side thereof, whereby means to actuate the latch are hinged to the end of the upper arm of the latch-type contrast means, and whereby tension spring means are connected at one end to the inner end of the means actuating the latch and at the other end to the body of the dummy bar.

According to the preferential embodiment of the invention the abutting means are arranged at the sides in the terminal cooperating portions at the detachable head and of the end of the dummy bar and consist of at least one lower protrusion extending towards the dummy bar and cooperating with a corresponding cutaway portion machined in the sides of the dummy bar, whereby a restricted play between terminal portions permit a limited one-way rotation of the detachable head in relation to the body of the dummy bar.

Moreover, according to the invention the means actuating the latch consist of a lengthwise bar able to run within the lodgement groove and comprise a rod protruding sideways thereto, whereby a stationary crosswise plate in the lodgement groove is located below said means actuating the latch and bears on its upper end a stop means able to limit the travel of the means actuating the latch towarads the body of the dummy bar.

According to the invention the protruding rod serves during the application of the detachable head, whereby the application is carried out with the help of a fork-shaped lever inserted into the lodgement groove between the rod and the crosswise plate and revolved in a direction away from the spring means so as to enable the latch means to be opened and the end of the dummy bar to be hooked thereby onto the detachable head.

According to another aspect of the invention the end of the dummy bar together with the lodgement groove of the dummy bar constitutes a block articulated with the body of the dummy bar, whereby the inner end of the spring means are anchored to the body of the dummy bar.

This enables the spring means to be slackened and the latch means to be opened thereby whenever the end block is revolved upwards in relation to the body of the dummy bar.

Other details and features of the invention will stand out from the description given below by way of non-limitative example and with reference to the accompanying drawings, in which.

Figure 1:
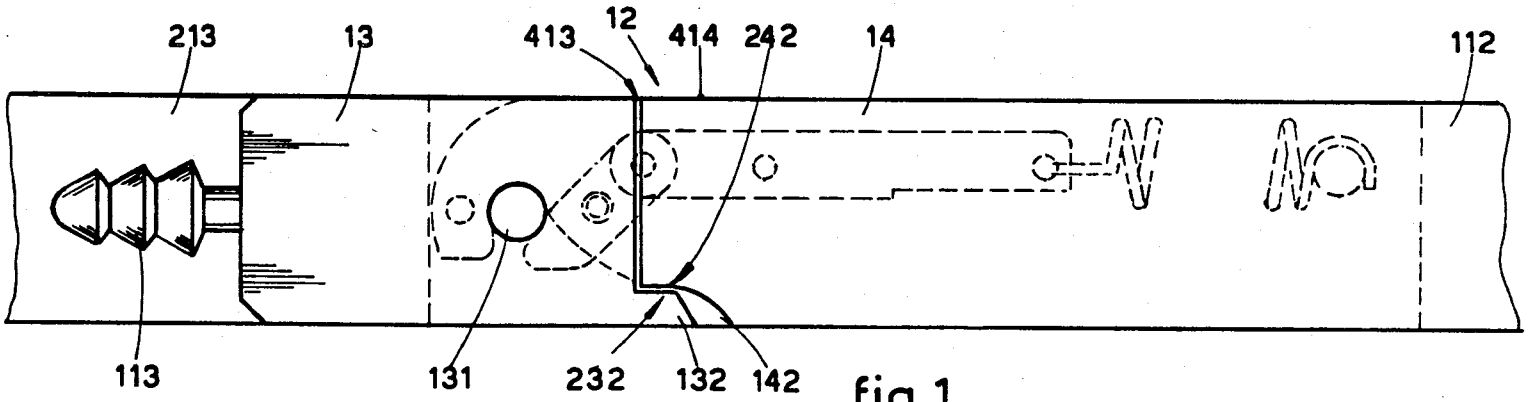
FIG. 1 shows the end of the invention fitted to the dummy bar and also shows the head that withdraws the billet.

With reference to the figures, the dummy bar 112 has an end 12 to which is attached a detachable head 13 with a connection 113 for withdrawing the billet 213. The dummy bar 112 has an end portion 14.

The head 13 comprises a lengthwise groove 313 provided in the end 413 facing the dummy bar 112.

The groove 313 has inside itself an attachment pin 131 located crosswise to the groove 313.

The inner end 413 comprises at each side of its lower portion an abutting protrusion 132 with an upper substantially flat surface 232.

The upper surface 232 of the protrusion 132 together with the face of the end 413 of the head 13 forms an L-shaped profile the task of which will be clarified hereinafter.

Figure 2:
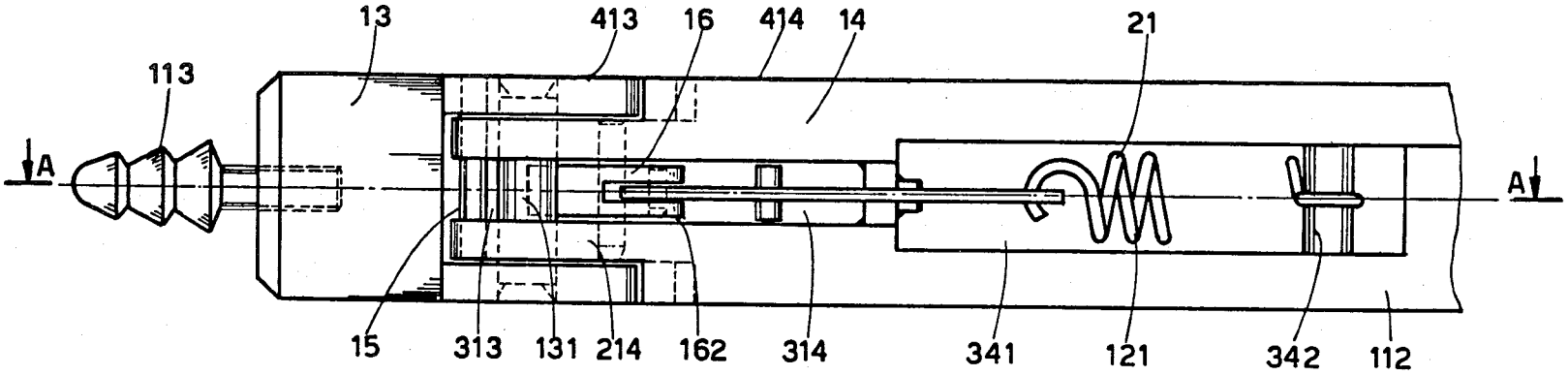
FIG. 2 shows a plan view of the end according to the invention.
Figure 3:
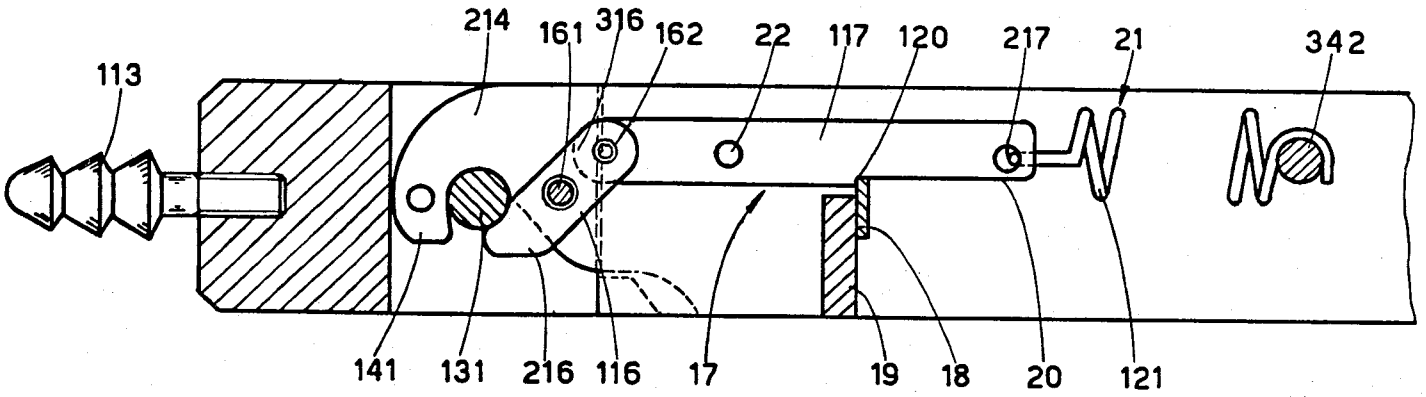
FIG. 3 shows a section of the end along the line 3—3 of FIG. 2.

The end portion 14 of the dummy bar comprises at its front a hook-shaped portion 214 having a width substantially smaller than the width of the groove 313 of the head 13, as can be seen in FIG. 2, whereby the hook 141 of the hook-shaped portion faces downwards in FIG. 2 and can cooperate with the attachment pin 131 as in FIG. 3.

The end portion 14 of the dummy bar also comprises a lodgement groove 314 provided in the hook portion and stretching along a certain distance within the body of the dummy bar 112.

The lodgement groove 314 comprises an inner portion 341 of a greater width than the portion nearest the hook 141, which is provided with a crosswise pin 342 the function of which will be clarified hereinafter.

The middle part 414 of the end portion 14 comprises on its outside on each side a notch 142, which is substantially bow-shaped and has a depth and height substantially the same as the thickness and height of the aforesaid protrusion 132 located at the inner end 413 of the detachable head 13.

Each of the notches 142 has a lower abutting surface 242 able to cooperate with the upper surface 232 of the corresponding protrusion 132 so as to form the abutting means 43.

A pin 15 is also located in the groove 314 in front of the hook means 131 and is employed for the lifting and handling of the dummy bar when the dummy bar is not in use.

Latch means 16 are also provided in the groove 314 of the dummy bar 112 and consist of a lever-shaped latch 116 pivoting on a pivot 161 anchored crosswise in the groove 314 near the hook means 141.

The latch 116 comprises on the outer edge of its lower arm 216 a spoon-shaped profile able to cooperate with the attachment pin 131 of the detachable head 13.

The upper end of the other arm 316 of the latch 116 is hinged at 162 to the outer end of the means 17 actuating the latch 116.

The means 17 actuating the latch consists of a bar 117 able to run lengthwise in the lodgement groove 314 and partially in the rear part 341 of the groove 314. The bar 117 has its inner end connected at 217 to the free end of known spring means 21, such as a tension spring 121 anchored at one end to the pin 342 provided at the inner part of the groove 341.

An upright stop means 18 is provided below the bar 117, so as to limit the longitudinal travel of the bar 117, and is anchored to a small crosswise plate 19 fixed in the lower part of the groove 341 so as not to interfere with the movement of the bar 117.

The stop means 18 extends vertically in correspondence with a cutaway portion 20 machined in the lower edge of the actuating bar 117.

The cutaway portion 20 comprises, at least in the part of itself towards the latch means 16, an abutting shoulder 120, the contact of which with the stop means 18 delimits the end of the movement of the actuating bar 117 towards the spring means 21 and thus hinders any excessive rotation in the direction of closure of the latch 116.

The bar 117 actuating the latch also comprises between its two ends a crosswise rod 22 protruding on both sides of the bar 117, whereby the rod 22 serves to open the latch means 16 while the detachable head 13 is being fitted to the body of the dummy bar 112.

This opening action is carried out with the help of a lever device which is inserted between the rod 22 and the small crosswise plate 19 and is revolved towards the end portion comprising the hook 214, thus overcoming the force of the spring 21 and causing the temporary opening of the latch 116, which permits the detachable head 13 to be lodged against the body of the dummy bar 112.

Figure 4:
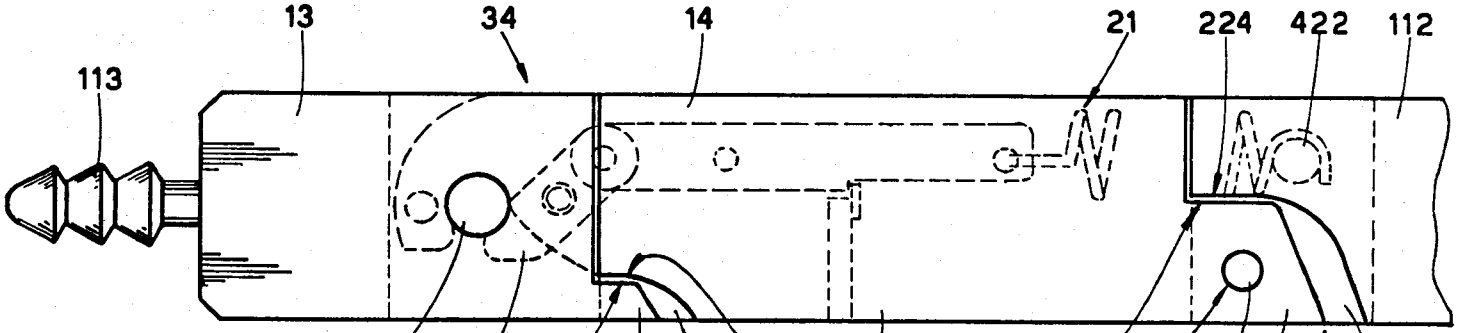
FIG. 4 shows a variant of the end according to the invention.

In the end 34 of FIG. 4, which is a variant of this invention, the hook-wise end portion 14 of the dummy bar 112 is pivoted at 23 on the body of the dummy bar 112 by means of a connecting pivot 123 so as to enable the hook-wise end 14 (together with the detachable head 13) to rotate in one direction, namely clockwise in relation to the body of the dummy bar 112, the inner end of the spring means 21 being anchored in this case to the body of the dummy bar 112 at the pin 422.

The pivoting joint 23 comprises abutting means 523 substantially like those already seen 132,232 and 142,242 provided between the detachable head 13 and the end part 14 except that in this last case the pivot 123 is disposed through two protrusions 322 which have upper surfaces 223 lodged together with inner surfaces 224 in the side notches 522.

The groove 341 also stretched partially into the body of the dummy bar 112 so as to lodge the anchorage pin 422 for the spring means 21 as well as a part of the spring means 21.

The remainder of the invention stays substantially unchanged.

The attachment of the head 13 to the end portion 14 of the dummy bar 112 is carried out with the dummy bar 112 in its position of rest in the parking station.

In the parking station the operator arranges to insert and operate the lever means so as to open the latch means 16.

Then with the latch 116 open the hook means 214 are positioned on the attachment pin 131.

When the lever means are withdrawn, the spring means 21 force the latch 116 to shut and cause a gripping action of the hook means 214 on the pin 131.

This gripping action hinders the unhooking of the detachable head 13 during the pulling of the billet and also the introduction of the dummy bar into the bottom of the ingot mold.

When the billet is extracted, the dummy bar halts its pulling action as soon as the billet has reached the extraction group.

It then becomes necessary to detach the end 12 of the dummy bar 112 from the billet 213 by means of a rather limited upward thrust of the body of the dummy bar 112, this thrust being obtained automatically by the lifting of the dummy bar 112 by the parking system.

In particular, there is an even quicker and more automatic detachment when the articulated end of the dummy bar in the variant of FIG. 4 is employed, since the substantially vertical lifting action entails the rotation of the body of the dummy bar in relation to the articulated block 34 and thereby leads to the slackening of the spring means 21 and thus the opening of the hook means 116 and thereafter the freeing of the detachable head 13, which stays attached to the billet.

It is clear that the ends 12 and 34 according to the invention can be fitted to any type of dummy bar.

A preferential embodiment of the invention has been described, but variants are possible. The shape and some constructional characteristics can be varied and other means can be adopted to actuate the opening and closing of the latch. Further variants lie within the knowledge of a person skilled in this field without departing from the scope of the invention.

I claim:

1. A dummy bar, comprising:

a body portion, two side portions and an end portion having a hook means of a width smaller than the bar and a lodgement groove of less width than said end portion stretching lengthwise in said dummy bar to define spaced side portions, a detachable head having two ends, one end carrying a means for attachment to a billet and the opposite end defining a vertical groove to form spaced sided containing an inside horizontal crosswise attachment pin, said groove permitting the lodgement of said hook portion of the dummy bar over said attachment pin, abutting means on lower parts of said side portions of said dummy bar and said sides of said head which enable said detachable head to rotate in one direction in relation to said side portions, latch means pivotable within said lodgement groove and capable of closing from below against said attachment pin, elongated means hinged at one end to said latch means, and tension spring means connected at one end to the other end of the elongated means and at the other end to the dummy bar.

2. The dummy bar as in claim 1, wherein said abutting means consist of a terminal protrusion located in the lower part on each side of the head and a notch stretching backwards which has a substantially bow-shaped profile machined in the lower part of each side portion, whereby an outer upper surface of said protrusion can cooperate with an inner surface of said notch.

3. The dummy bar as in claim 1 or claim 2, wherein said latch means consist of a latch shaped like a lever pivoting on a pin anchored horizontally crosswise in the front part of said lodgement groove, said latch having a free end cooperating with said attachment pin and another end hinged to said elongated means.

4. The dummy bar as in claim 1 or claim 2, wherein said elongated means actuating the latch consist of a bar running in said lodgement groove and having its front end hinged to an upper end of the latch and its rear end connected to a free end of said spring means.

5. The dummy bar as in claim 1 or claim 2 including a pin positioned transversely of said lodgement groove and wherein said tension spring means consist of a spring of which an inner end is secured to said pin.

6. The dummy bar as in claim 4, wherein said bar actuating the latch comprises a rod projecting from the sides of said bar crosswise within the lodgement groove.

7. The dummy bar as in claim 4, including stop means within said lodgement groove solidly fixed to the side portions and wherein said bar actuating the latch comprises on its lower edge near its backward end a cutaway portion and in its front part an abutting shoulder which is able to cooperate with said stop means.

8. The dummy bar as in claim 7, including a plate in said lodgement groove only and wherein said stop means is anchored to said small plate.

9. The dummy bar as in claim 1 or claim 2, wherein said side portions of the dummy bar are articulated at its rear together with the body portion of the dummy bar.

10. The dummy bar as in claim 9, wherein said side portions and body define abutting means consisting of a terminal protrusion on the lower rear edge on each side of the lodgement groove of said side portions and a corresponding notch having a substantially bow-shaped profile machined in the outer lower edge and on each side of the body of the dummy bar, an upper outer surface of said protrusion cooperating with an inner surface of said notch.

* * * * *